US005921839A

United States Patent [19]

Siren

[11] Patent Number: 5,921,839

[45] Date of Patent: Jul. 13, 1999

[54] SIMULATED AIRCRAFT PILOTING DEVICE

[76] Inventor: Jay D. Siren, 450 S. Albertson Ave., Covina, Calif. 91723

[21] Appl. No.: 08/831,658

[22] Filed: Apr. 9, 1997

[51] Int. Cl.[6] ..... A63H 17/00

[52] U.S. Cl. ..... 446/7; 40/358; 40/411

[58] Field of Search ..... 40/358, 411, 415; 446/7, 230, 231, 232

[56] References Cited

U.S. PATENT DOCUMENTS

| | | | |
|---|---|---|---|
| Re. 34,057 | 9/1992 | Middlesworth . | |
| 1,937,241 | 11/1933 | Pardue et al. | 446/7 X |
| 2,814,276 | 11/1957 | Craig . | |
| 3,691,669 | 9/1972 | Folson et al. | 446/230 |
| 3,966,162 | 6/1976 | Hadley . | |
| 4,152,950 | 5/1979 | Langford . | |
| 4,421,485 | 12/1983 | Geschwender | 446/230 X |
| 4,459,870 | 7/1984 | Gill et al. . | |

FOREIGN PATENT DOCUMENTS

| | | | |
|---|---|---|---|
| 108184 | 5/1984 | European Pat. Off. | 446/232 |
| 2258433 | 2/1993 | United Kingdom . | |

OTHER PUBLICATIONS

1964–65 Lindberg Products, Inc. Catalog, p. 13, 1964.

*Primary Examiner*—Michael F. Trettel
*Assistant Examiner*—Andrea Chop
*Attorney, Agent, or Firm*—Boniard I. Brown

[57] ABSTRACT

A simulated aircraft piloting device for use as a desk top pen holder or amusement device has a simulated aircraft mounted on a base for movement about simulated pitch, roll, and yaw axes relative to the base, and a simulated aircraft control stick on the base connected to the aircraft for moving the aircraft about its simulated pitch, roll, and yaw axes.

14 Claims, 3 Drawing Sheets

SIMULATED AIRCRAFT PILOTING DEVICE

BACKGROUND OF THE INVENTION

1. Field of the Invention

This invention relates generally to devices of the class which are commonly referred to as novelty or gift items and more particularly to a novel simulated aircraft piloting device which is particularly suited for use as either a desktop pen holder or a desktop amusement device.

2. Discussion of the Prior Art

Over the years, pen holders have been very popular as desktop accessories and highly favored as novelty or gift items. Desktop pen holders are available in a wide variety of styles, complexities, and costs but all have the same basic structure of a base and a socket-like receiver for removably receiving a writing pen, such as a fountain pen or a ball point pen. The simulated aircraft piloting device of this invention is particularly suited for use as such a pen holder.

British patent application publication No. 2,256,433 A discloses a desktop pen holder embodying a simulated aircraft piloting device. Simply stated, this pen holder includes a base mounting a simulated aircraft and a simulated aircraft controller in the form of simulated flight control stick, and fishing lines connecting the aircraft and control stick for effecting movement of the aircraft in response to movement of the stick. The simulated flight control stick includes a pen receiver and writing pen removably positioned in the receiver. The aircraft is mounted on the base for simulated roll movement about a simulated roll axis extending longitudinally of the aircraft fuselage and simulated pitch movement about a simulated pitch axis transverse to the roll axis. The pen receiver of the simulated aircraft control stick is pivotally mounted on the base for simulated aircraft roll and pitch control movements and is connected to the aircraft by fishing lines in a manner such that the aircraft is movable in roll and pitch by moving the pen of the flight control stick. The simulated aircraft of this pen holder is not capable of simulated aircraft yaw movement about a yaw axis.

As mentioned above, the lower end of the simulated flight stick of the patented pen holder is connected to the simulated aircraft by fishing lines which transmit the movements of the stick to the aircraft. The following patents disclose mechanical linkage arrangements for transmitting movements from a movable controller to a movable part: No. 2,814,276 dated Nov. 26, 1957, to Craig; No. 3,966,162 dated Jun. 29, 1976, to Hadley; No. 4,152,950 dated May 8, 1979, to Langford; No. 4,459,870 dated Jul. 17, 1984, to Gill et al; No. RE. 34,057 dated Sep. 8, 1992, to Middlesworth.

BRIEF DESCRIPTION OF THE INVENTION

This invention provides an improved simulated aircraft piloting device of the character described including a base, a simulated aircraft mounted on the base for simulated roll, pitch and yaw movements relative to the base about simulated roll, pitch and yaw axes, respectively, a simulated aircraft controller mounted on the base for simulated aircraft control movements relative to the base, and means connecting the controller and aircraft, whereby the aircraft is selectively movable about its roll, pitch, and yaw axes by appropriate movement of the controller. In one preferred embodiment described herein, the simulated aircraft piloting device of the invention is a desktop pen holder whose aircraft controller is a simulated aircraft control stick including a pen receiver and a writing pen removably positioned in the receiver. In another described embodiment the simulated aircraft piloting device is essentially a desktop amusement device or toy whose simulated aircraft controller is a simulated control stick resembling an actual aircraft flight control stick.

An important and unique feature of the preferred inventive embodiment resides in the manner in which the simulated aircraft and the simulated aircraft controller are mounted on the base and connected to one another for movement of the aircraft by movement of the controller. According to this feature, the controller comprises a controller shaft having a lower end which projects through an opening in the upper side of the base into a cavity within the base and an upper end which extends above the base. The aircraft is mounted on the upper end of an aircraft support shaft having a lower end which projects through an opening in the upper side of the base into the base cavity and whose upper end extends above the base. Each shaft is supported on the base for rotation of the shaft on its longitudinal axis relative to the base and for pivotal movement of the shaft relative to the base in any direction about a pivot center on the shaft axis between the shaft ends. The lower ends of the two shafts are joined by connecting means within the base cavity in such a way that the aircraft support shaft rotates on its longitudinal axis in unison with rotation of the controller shaft on its longitudinal axis, and the aircraft support shaft pivots about its pivot center in unison with pivotal movement of the controller shaft about its pivot center, all in such manner that the two shafts remain parallel to one another throughout the range of their movement.

The connecting means of the described inventive embodiment which connects the lower ends of the aircraft support shaft and controller shaft is a parallel linkage mechanism including rigid parallel links extending between and having ends pivotally connected to radial arms on the shafts on first pivot axes parallel to and spaced laterally from the longitudinal axes of the shafts and second pivot axes transverse to both the links and the shafts. The preferred connecting means described herein includes, in addition to such links, a rigid stabilizing bar having ends pivotally connected to the aircraft support shaft and controller shaft on the longitudinal axes of these shafts and on pivot axes transverse to both the shafts and the stabilizing bar.

According to a preferred feature of the invention, the aircraft support shaft and controller shaft are pivotally mounted on the base by swivel bearings located within the base openings through which the shafts extends. Each swivel bearing includes a bearing ball on the respective shaft and bearing socket members within the respective base opening between which the ball is caged and which socket members are relatively adjustable to adjust contact pressure between the ball and socket members. This contact pressure is adjusted to provide just sufficient frictional contact of the socket members with the balls to lightly retain the two shafts in any pivotal position. According to yet another feature of the invention, the aircraft is adjustably mounted on the upper end of its support shaft to permit adjustment of the orientation of the aircraft relative to the support shaft and thereby the orientation of the aircraft relative to the base independent of the controller.

DESCRIPTION OF THE PREFERRED EMBODIMENT

Figure 12:
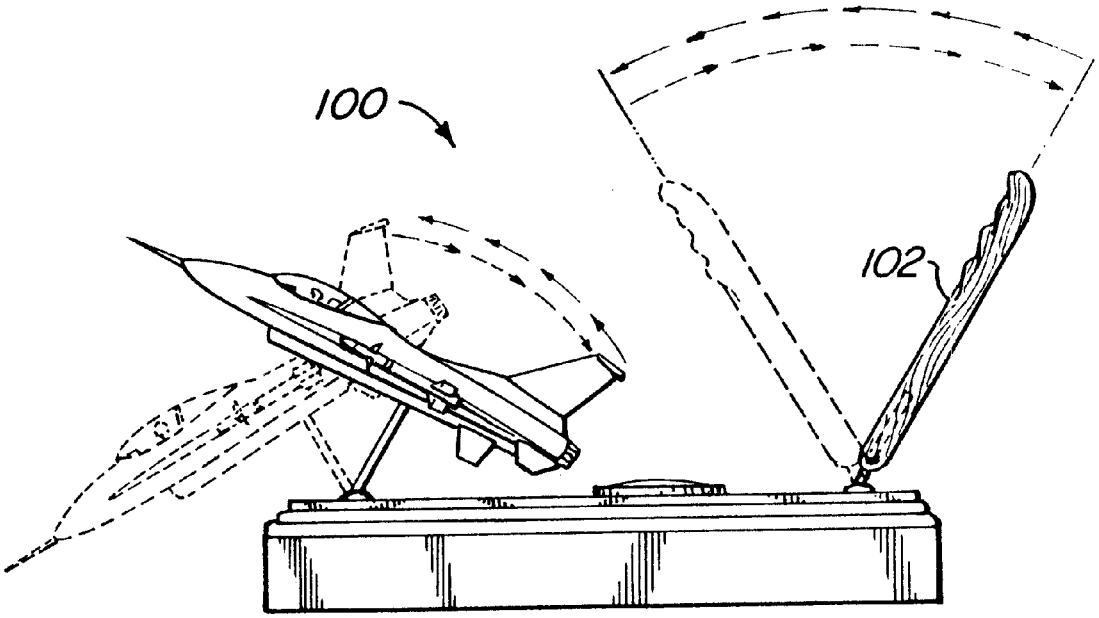
FIG. 12 is a fragmentary showing of a modified simulated aircraft piloting device according to the invention which is simply a desk top toy or amusement device rather than a pen holder.

Turning now to these drawings, and first to FIGS. 1–11, there is illustrated a simulated aircraft piloting device 20 according to the invention. This device has a base 22, a simulated aircraft 24 above the base, an aircraft support member 26, aircraft mounting means 28 movably mounting this support member on the base 22 for simulated roll (FIG. 4), pitch (FIG. 2) and yaw (FIG. 3) movements of the aircraft relative to the base, a simulated aircraft controller 30, controller mounting means 32 mounting the controller 30 on the base for simulated aircraft control movements relative to the base, and connecting means 34 connecting the controller 30 and the aircraft support 28 for effecting roll, pitch, and yaw movements of the aircraft in unison with certain control movements of the controller. As mentioned earlier, this invention contemplates within its scope two possible configurations of the simulated aircraft piloting device, namely a desktop pen holder and a desktop toy or amusement device. FIGS. 1–11 illustrate the pen holder configuration. FIG. 12 illustrates the desktop toy configuration.

Referring now in more detail to FIGS. 1–11, the base 22 of the illustrated simulated aircraft piloting device or pen holder 20 is a rectangular shell-like block of wood or other suitable material having a cavity 36 opening through the lower side of the block. The upper edges of the block may be contoured, as shown, for ornamental purposes.

The simulated aircraft controller 30 is a simulated aircraft control stick including a shaft 38 having an upper end above the base 22 and a lower end which projects through an opening 40 in the upper side of the base into the base cavity 36. On the upper end of this shaft is an upwardly opening socket-like pen receiver 38*a* removably receiving a writing pen 38*b*. Controller shaft 38, pen receiver 38*a*, and writing pen 38*b* together form a simulated aircraft control stick. Controller mounting means 32 comprises a swivel bearing within the base opening 40 mounting the controller shaft 38 on the base 22 for rotation of the shaft on its longitudinal axis relative to the base and for pivotal movement of the shaft in any direction about a pivot center 42 on the longitudinal axis and between the upper and lower ends of the shaft.

Figure 9:
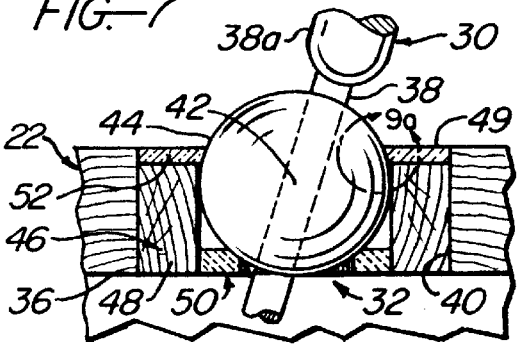
FIG. 9 is an enlargement of the area encircled by the arrow 9 in FIG. 7.
Figure 9A:
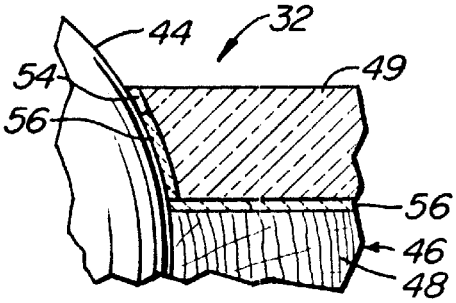
FIG. 9A is an enlargement of the area encircled by the arrow 9A in FIG. 9.
Figure 10:
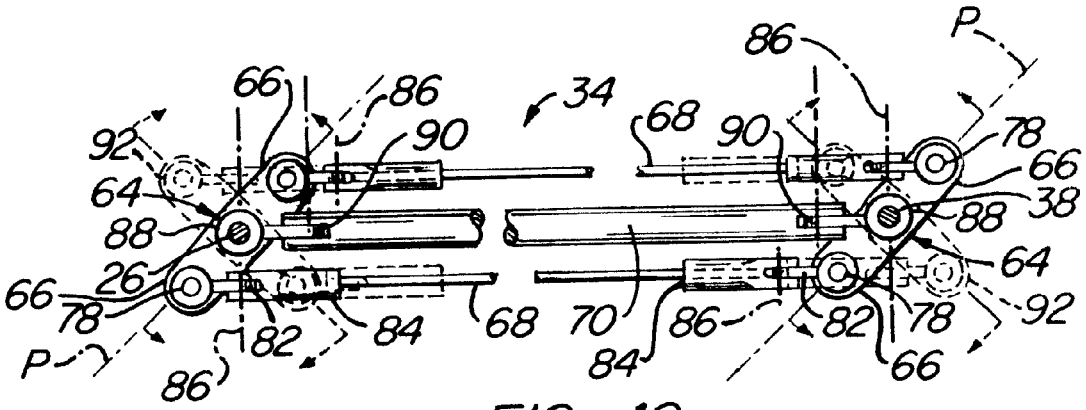
FIG. 10 is an enlarged view of the linkage mechanism shown in FIG. 6.
Figure 11:
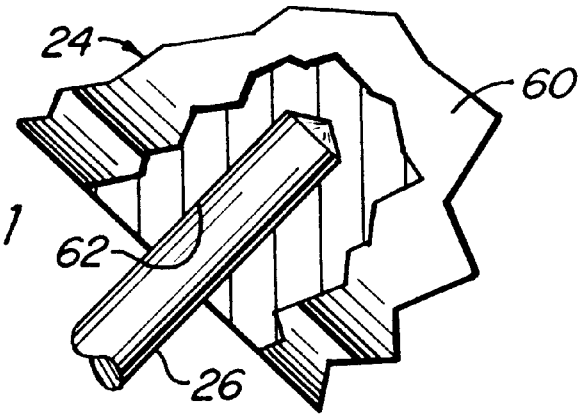
FIG. 11 is an enlargement of the area encircled by the arrow 11 in FIG. 2.

The illustrated swivel bearing 32 includes a bearing ball 44 rigid on the shaft 38 with its geometric center located at the pivot center 42 and a swivel socket 46 containing the ball for universal swivel movement and rotation of the ball about the pivot center. Socket 46 includes a hardwood sleeve 48 fixed within the base opening 40 and socket members 49, 50 at the ends of the sleeve. Sleeve 48 is internally sized to rotatably receive the bearing ball 44. This sleeve has a length slightly less than the axial length of the opening so as to form a shallow recess 52 at the upper end of the sleeve whose bottom is the upper end face of the sleeve. The upper socket member 49 is an annular bearing plate or ring adhesively bonded or otherwise fixed within this recess flush with the upper side of the base 22. The lower socket member 50 is an annular bearing plate or ring fixed within the lower end of the sleeve 48 in the manner explained below. Each bearing plate contains a central circular opening through which the shaft 38 extends. This opening in each bearing plate has a diameter less than the diameter of the bearing ball 44 and is bounded circumferentially by an edge which is tapered and contoured to conform somewhat to the surface of the bearing ball 44, as shown best in FIG. 9A. This figure illustrates in enlarged detail the upper bearing plate 49 and the tapered, contoured edge 54 of its opening.

The upper bearing plate 49 is preferably a polished brass washer or ring whose bottom surface and the lodge 54 of its opening are coated (FIG. 9A) with a thin layer 56 (0.01 inch) of nylon or other material having a low coefficient of friction which forms a bearing surface for the ball 44. The lower bearing plate 50 is preferably composed of nylon or other material having a low coefficient of friction.

Bearing ball 44 is positioned within the hardwood sleeve 48 and confined between the upper and lower socket members or bearing plates 49, 50 in a manner which permits swivel movement of the ball about its pivot center 42 and rotation of the ball with the shaft 38 about the longitudinal axis of the shaft. As mentioned above, the upper bearing plate 49 is fixed in position. The lower bearing plate 50 is sized to have a friction fit within the sleeve 48 such that this plate may be adjusted axially in the sleeve at time of manufacture to establish a certain contact pressure between the ball and bearing plates. This contact pressure is made such as to permit relatively free swivel and rotational movement of the bearing ball 44 in the swivel socket 46 by manual forces applied to the aircraft controller or control stick 30 during operation of the aircraft piloting device 20 and yet frictionally retain the control stick in fixed position relative to the base 22 in the absence of such forces. After adjustment, the lower bearing plate 50 may be adhesively bonded or otherwise fixed in adjusted position.

The aircraft support member 26 is a shaft similar to the controller shaft 38 and having an upper end above the base 22 and a lower end which projects through an opening 58 in the upper side of the base into the base cavity 36. The aircraft mounting means 28 mounting the aircraft support member or shaft 26 on the base comprises a swivel bearing which is identical in every respect to the swivel bearing 32 of FIG. 9 for the aircraft controller 30. Accordingly, it is unnecessary to describe the aircraft swivel bearing 28. Suffice it to say that the swivel bearing 28 supports the aircraft support shaft 26 on the base 22 for rotation on the longitudinal axis of this shaft and for swivel movement of the shaft about a pivot center located on the longitudinal axis and between the ends of the shaft and at the center of the bearing ball (not shown) of the swivel bearing 28.

The simulated aircraft 24 is mounted on the upper end of the aircraft support shaft 26. According to a preferred feature of the invention, the underside of the aircraft fuselage 60 contains a socket 62 between the ends of the fuselage which receives the upper end of the shaft 26 with a light friction fit. This light friction fit is made sufficiently tight to retain the aircraft in a fixed position on the shaft and yet permit removal of the aircraft from the shaft for convenience of storage of the simulated aircraft piloting device 20 as well as rotational adjustment of the aircraft relative to the shaft about the longitudinal axis of the shaft in order to adjust the orientation of the aircraft relative to the base 22. The axis of socket 62 intersects the longitudinal axis of the aircraft fuselage approximately normal to a plane (wing plane) passing through the fuselage axis parallel to the aircraft wings.

The lower ends of the aircraft support shaft 26 and controller shaft 38 extend below their respective swivel bearings 28, 32 into the base cavity 36. These lower shaft ends are connected by the connecting means 34 for rotation of the aircraft support shaft on its longitudinal axis by rotation of the controller shaft on its longitudinal axis and pivotal movement of the aircraft support shaft about its pivot center 42 by pivotal movement of the controller shaft about its pivot center 42. This unified movement of the shafts occurs in such manner that the shafts remain parallel to one another throughout their range of movement. The illustrated connecting means 34 comprises a parallel linkage mechanism including brackets 64 fixed on the lower ends of the shafts 26, 38 having bracket arms 66 extending in opposite radial directions from their respective shafts, parallel rigid links 68 extending between and pivotally connected to the outer ends of these bracket arms, and a rigid stabilizing bar 70 between and parallel to the links 68 and extending between and pivotally connected to the lower ends of the shafts. It is possible that this stabilizing bar may be omitted in some cases.

Each bracket 64 comprises an elongate plate transverse to its respective shaft 26, 38 and having tapered ends forming the bracket arms 66. Rigid on the underside of each bracket plate midway between its ends is a boss 72 through which the respective shaft 26, 38 extends. Threaded in this boss of each bracket is a set screw 74 which rigidly secures the bracket to its shaft for rotation of the bracket and shaft in unison. Rotatably secured by screws 76 to the upper sides of the bracket arms 66 for rotation relative to the arms on axes 78 parallel to and laterally spaced equal distances from the respective shafts 26, 38 are link attachment members 80. The longitudinal axis of each shaft 26, 38 and the pivot axes 78 of the two link attachment members 80 on the bracket 64 of the respective shaft are located in a common plane P (FIGS. 6 and 10) hereafter referred to as the axis plane of the shaft. Link attachment members 80 have tongues 82 in planes containing their rotation axes 78 which engage slidably in axial slots in fittings 84 fixed on the ends of the links 68. The tongues 82 are pivotally connected to the fittings 84 on pivot axes 86 transverse to both the pivot axes 78 and the longitudinal axes of the links 68. At least one fitting 84 on each link 68 is threaded on the link to permit the effective lengths of the links 68 between the link pivot axes 78 to be equalized so as to form the links and the brackets 64 into a parallelogram in which the pivot axes 78 are located at the four corners of the parallelogram.

Rotatable on the lower end of each shaft 26, 38 above its bracket 64 is a collar 88 which is restrained in any convenient way against axial movement along the shaft. Each collar 88 has a tongue 90 in a plane containing the longitudinal axis of the respective shaft. The collar tongues 90 slidably engage in parallel axial slots entering the ends of the stabilizing bar 70 and are pivotally secured to the ends of the bar on pivot axes 92 transverse to both the shafts 26, 38 and the stabilizing bar.

Figure 1:
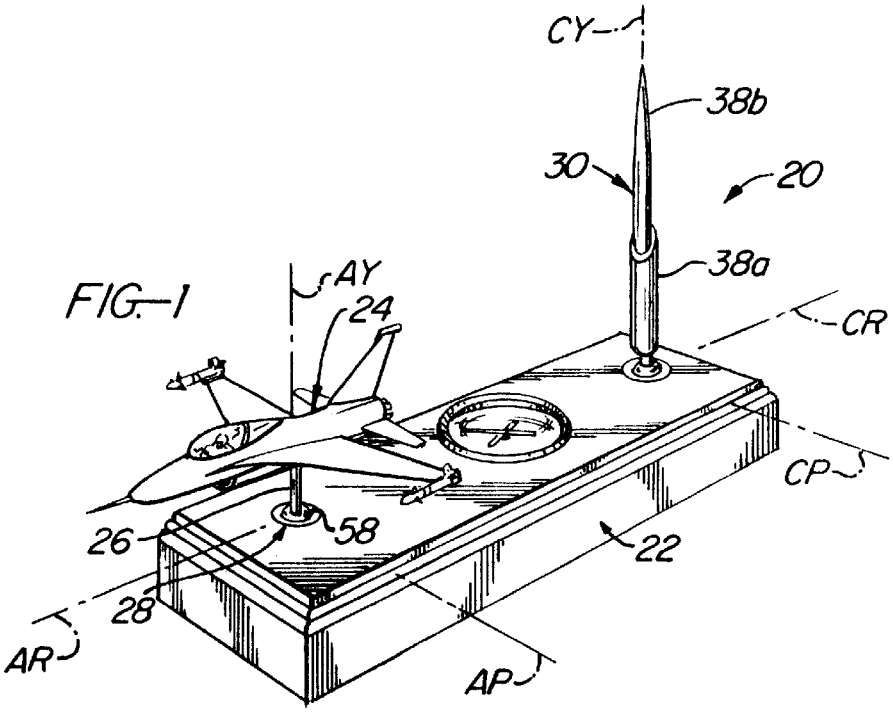
FIG. 1 is a perspective view of a simulated aircraft piloting device of the invention in the form of a desktop pen holder.
Figure 2:
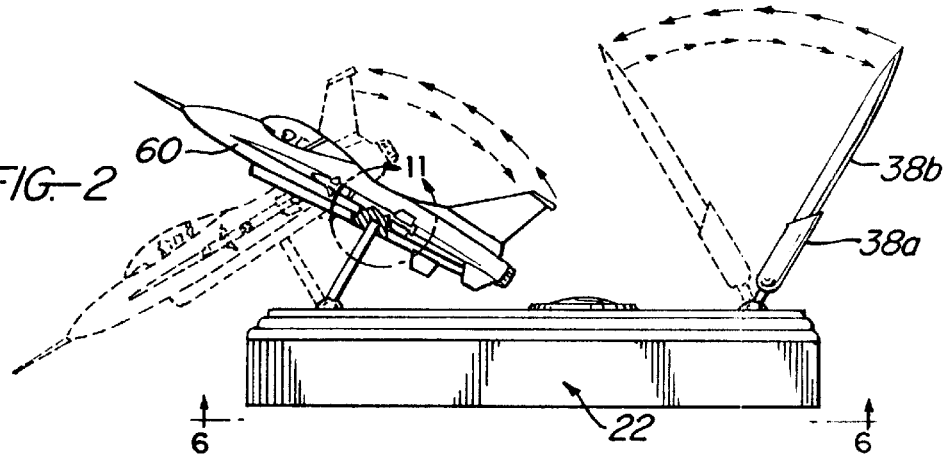
FIG. 2 is a side elevation of the simulated aircraft piloting device illustrating simulated pitch movement of the aircraft.

From the description to this point, it is evident that (a) the aircraft support shaft 26 and the controller shaft 38 may be considered as having mutually perpendicular axes designated as CY, CP, CR and AY, AP, AR in FIG. 1 which intersect at the pivot centers 42 of the respective shafts and (b) the shafts are rotatable in unison on these axes. Axes CY and AY are the longitudinal axes of the shafts 38 and 26, respectively, and parallel one another. Axes CP and AP parallel one another and extend transverse to the axes CY, AY, respectively, in the axis planes P of the respective shafts. Axes CR and AR are normal to the axis planes P of the respective shafts and parallel one another.

Assume now that the aircraft 24, the aircraft support shaft 26, and the controller shaft 38 occupy their positions of FIG. 1. In these positions, the shafts are upright (i.e. normal to the base 22 and vertical when the base is placed on a horizontal surface, such as a desktop), The longitudinal axis of aircraft fuselage is located in the common plane of the shafts and intersects the shaft axes at approximately right angles. In this orientation of the aircraft 24, axis AR extends parallel to the longitudinal axis of the aircraft fuselage in a plane containing the fuselage axis and the axis of the support shaft 26 and constitutes a simulated roll axis, hereafter referred to simply as a roll axis, of the aircraft. Axis AP extends normal to the axis AR in the wing plane of the aircraft and constitutes a simulated pitch axis, hereafter referred to simply as a pitch axis, of the aircraft. Axis AY is normal to both the roll and pitch axes AR, AP and constitutes a simulated yaw axis, hereafter referred to simply as a yaw axis, of the aircraft.

Figure 3:
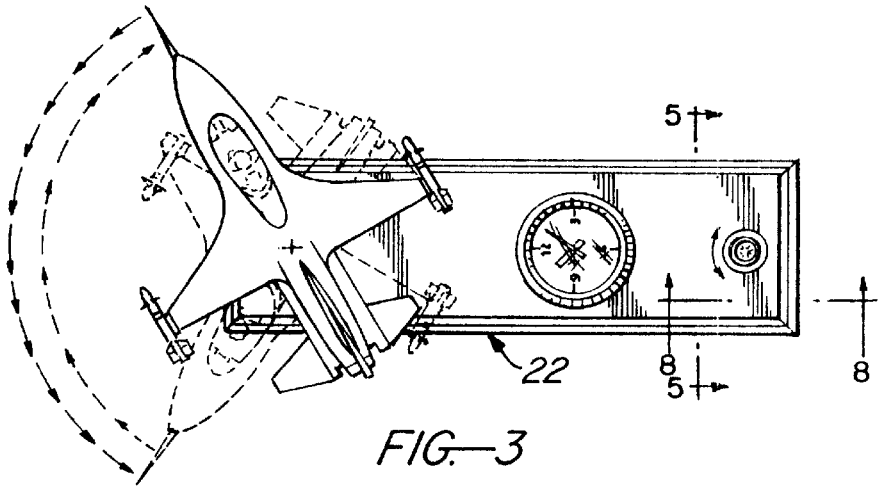
FIG. 3 is a top view of the simulated aircraft piloting device illustrating simulated yaw movement of the aircraft.
Figure 4:
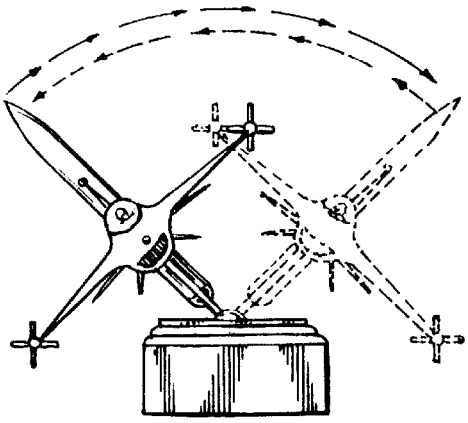
FIG. 4 is an end view of the simulated aircraft piloting device illustrating simulated roll movement of the aircraft.
Figure 5:
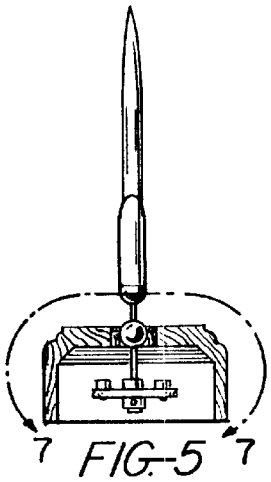
FIG. 5 is section taken on line 5—5 in FIG. 3.
Figure 6:
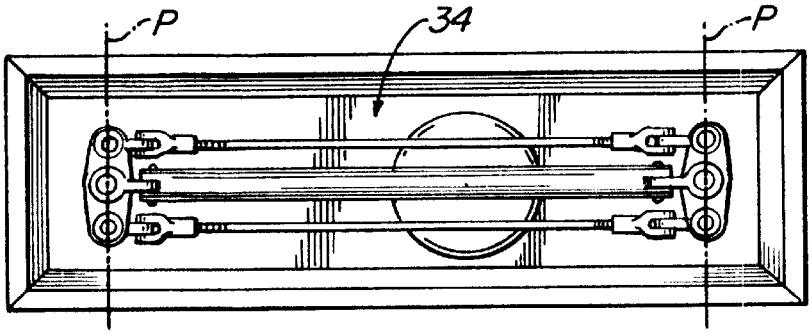
FIG. 6 is a bottom view of the simulated aircraft piloting device in FIG. 1 looking in the direction the arrows on line 6—6 in FIG. 2.
Figure 7:
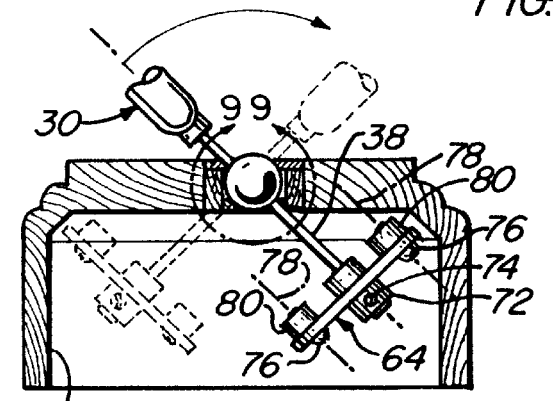
FIG. 7 is an enlargement of the area encircled by the arrow 7—7 in FIG. 5 and illustrating a certain control movement of the aircraft controller of the simulated aircraft piloting device.
Figure 8:
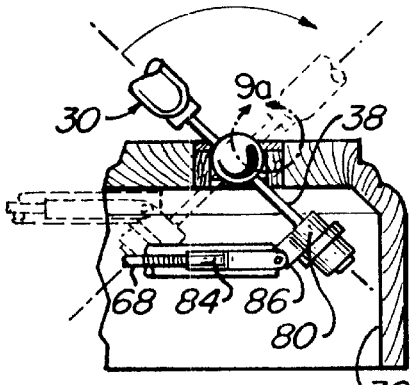
FIG. 8 is an enlarged section taken on line 8—8 in FIG. 3 and illustrating another control movement of the aircraft controller.

Rotation of the simulated aircraft controller or control stick 30 on its axis CY, hereafter referred to as its yaw control axis, as indicated by the circular arrow in FIG. 3 moves the parallel links 68 of the parallel linkage mechanism 34 longitudinally in opposite directions to rotate the aircraft support shaft 26 and thereby the aircraft 24 on the yaw axis AY, as indicated by the solid and broken lines in FIG. 3. Rotation of the control stick 30 on its axis CP, hereafter referred to as its pitch control axis as indicated by the solid and broken lines in FIGS. 2 and 8, moves the parallel links 68 longitudinally in the same direction to rotate the aircraft support shaft 26 and the aircraft 24 on the pitch axis AP, as illustrated in solid and broken lines in FIG. 2. Rotation of the control stick 30 on its axis CR, hereafter referred to as its roll control axis as indicated by the solid and broken lines in FIG. 7, moves the parallel links 68 and the stabilizing bar 70 of the linkage mechanism 34 laterally to rotate the aircraft support shaft 26 and the aircraft 24 on the roll axis AR, as illustrated in solid and broken lines in FIG. 4. The yaw, pitch, and roll control movements of the control stick 30 may performed individually to move the aircraft in its yaw, pitch, and roll modes individually, as just described, or in any combination to move the aircraft in any two or in all three of its yaw, pitch, and roll modes simultaneously. It is obvious, of course, that during the above movements of the control stick 30 and aircraft 24, the relative positions of the axes AR, AP, AY and the relative positions of the axes CR, CP, CY remain fixed and the corresponding axes remain parallel to one another. On the other hand, the positions of the axes relative to the base 22 do not remain fixed in their positions of FIG. 1 but rather change, as shown in the drawings. If the pivotal connections between the bracket arms 66 and the links 68 are sufficiently firm and free of play, it may be possible to omit the stabilizing bar 70.

In the roll mode, when the aircraft and pen are relatively heavy, the linkage mechanism 34 may allow further roll movement than desired because of inertial effects of the weight of the mechanism 34 in comparison with the weights of the aircraft and pen. This excess roll problem may be prevented by providing that the stabilizer bar 70 be sufficiently heavy to provide sufficent counter-weight.

As noted earlier, the aircraft 24 is rotatable on its support shaft 26 to adjust the orientation of the aircraft relative to the base 22 independently of the aircraft control stick 30. Axis AY will remain the yaw axis of the aircraft in all such orientations of the aircraft. The functional names of the axes AP and AR may change, however, depending upon the orientation of the aircraft relative to the base. For example, it the aircraft is rotated 90 degrees from its position of FIG. 1, axis AP becomes the roll axis of the aircraft and axis AR becomes the pitch axis of the aircraft. In intermediate orientations of the aircraft, rotation of the aircraft about each of the axes AP, AR may result in both pitch and roll components of the aircraft.

FIG. 12 illustrates a modified simulated aircraft piloting device 100 according to the invention which is identical in all respects to the simulated aircraft piloting device or pen holder 20 of FIGS. 1–11 except that the pen holder control stick 30 of the device 20 is replaced by a simulated one piece aircraft control stick 102 closely resembling an actual aircraft control stick. The aircraft piloting device 100 is a desk top amusement device which is otherwise identical in construction and operation to the aircraft piloting device 20.

The inventor claims:

1. A simulated aircraft piloting device comprising:

a base having upper and lower sides and defining an interior space, a simulated aircraft, an aircraft mounting comprising an aircraft support shaft having a longitudinal axis, a lower end projecting into said base interior space through a support shaft opening in the upper side of said base and an upper end extending above said base, said shaft being supported on said base for rotation of the shaft on its longitudinal axis relative to said base and pivotal movement of the shaft relative to said base in any direction about a pivot center located on said axis between said ends of said shaft, and said aircraft being mounted on the upper end of said shaft for movement of the aircraft with said shaft, a controller including a controller shaft having a longitudinal axis, a lower end projecting into said base interior space through a controller shaft opening in the upper side of said base and an upper end extending above said base, said controller including a control member secured to the upper end of said controller shaft and adapted to be manipulated by a user for rotating said controller shaft on its longitudinal axis and pivoting said controller shaft about its pivot center, said controller shaft being supported on said base for rotation of the controller shaft on its longitudinal axis relative to said base and pivotal movement of the controller shaft relative to said base in any direction about a pivot center located on said controller shaft axis between said ends of said controller shaft, the lower ends of said aircraft support shaft and said controller shaft being connected for rotation of said support shaft on its longitudinal axis by rotation of said controller shaft on its longitudinal axis and for pivotal movement of said support shaft about its pivot center by pivotal movement of said controller shaft about its pivot center by a mechanical linkage mechanism comprising brackets rigid on the lower ends of said shafts and including arms extending radially from said shafts, elongate rigid links extending between said bracket arms, and pivotal connections between the ends of said links and said bracket arms on first pivot axes parallel to and laterally spaced from the longitudinal axes of the shafts with second pivot axes transverse to both said first pivot axes and the length of said links, and an elongate stabilizing bar extending between said shafts and having its respective opposite end portions pivotally connected with respective ones of the shafts, said shafts having parallel pivot axes transverse to the stabilizing bar.

2. A simulated aircraft piloting device according to claim 1 wherein:

said support shaft being supported on said base by a swivel bearing within said support shaft opening in said base, and said controller shaft being supported on said base by a swivel bearing within said controller shaft opening in said base.

3. A simulated aircraft piloting device according to claim 2 wherein:

each swivel bearing includes a swivel socket within the respective base opening, and a bearing ball on the respective shaft contained within said socket for swivel movement in the socket.

4. A simulated aircraft piloting device according to claim 3 wherein:

said socket of each swivel bearing comprises a pair of socket members at opposite sides of the respective bearing ball and engaging the respective bearing ball with a contact pressure which is adjustable by adjustment of one socket member relative to the other socket member.

5. A simulated aircraft piloting device according to claim 1 wherein:

said aircraft includes a fuselage having opposite ends and a lower side, and said aircraft support shaft extends downwardly from the lower side of said fuselage between the ends of the fuselage.

6. A simulated aircraft piloting device according to claim 5 wherein:

said aircraft being mounted on the upper end of said aircraft support shaft by means for adjusting the orientation of the aircraft relative to said support shaft.

7. A simulated aircraft piloting device according to claim 1 wherein:

said device is a desktop pen holder, and said control member comprising a pen receiver on said controller shaft, and a writing pen removably positioned in said receiver.

8. A simulated aircraft piloting device according to claim 1 wherein:

said aircraft support shaft being supported on said base by a swivel bearing within said support shaft opening in said base, said controller shaft being supported on said base by a swivel bearing within said controller shaft opening in said base, each swivel bearing includes a socket forming a swivel socket within the respective base opening, and a bearing ball on the respective shaft contained within said socket for swivel movement in the socket, and said socket of each swivel bearing comprises a pair of socket members at opposite sides of the respective bearing ball and engaging the respective bearing ball with a contact pressure which is adjustable by adjustment of one socket member relative to the other socket member.

9. A simulated aircraft piloting device according to claim 1, and further including: said pivotal connections of said stabilizing bar comprising respective collars rotatable on the lower end portions of said respective shafts, and said elongate stabilizing bar being connected with and extending between said collars.

10. A device comprising:

a base having upper and lower sides and defining an interior space, a first shaft having a longitudinal axis, a lower end projecting into said interior space through a support shaft opening in said base and an upper end extending above said base, and said shaft being supported on said base for rotation of the shaft on its longitudinal axis relative to said base and pivotal movement of the shaft relative to said base about a pivot center located on said axis between said ends of said shaft, a second shaft having a longitudinal axis, a lower end projecting into said base interior space through a controller shaft opening in the upper side of said base and an upper end extending above said base, said second shaft being supported on said base for rotation of said second shaft on its longitudinal axis relative to said base and pivotal movement of the second shaft relative to said base in any direction about a pivot center located on said second shaft axis between said ends of said second shaft, means within said base interior space connecting the lower ends of said shafts for rotation of said shafts in unison on their longitudinal axes and pivotal movement of said shafts in unison about their pivot centers, said means connecting the lower ends of said shafts comprising a mechanical linkage comprising brackets rigid on the lower ends of said shafts and including arms extending radially from said shafts, and a pair of elongate rigid links extending between said bracket arms, said links being pivotally connected to said bracket arms on first pivot axes parallel to and laterally spaced from said shafts and second pivot axes transverse to both said first pivot axes and said links, and an elongate stabilizing bar between said shafts and having respective opposite end portions pivotally connected with respective ones of the shafts, said shafts having parallel pivot axes transverse to the stabilizing bar.

11. A device according to claim 10 wherein:

said first shaft being supported on said base by a first swivel bearing on said base, and said second shaft being supported on said base by a second swivel bearing on said base.

12. A simulated aircraft piloting device according to claim 11 wherein:

each swivel bearing includes a socket forming a swivel socket within the respective base opening, and a bearing ball on the respective shaft contained within said socket for swivel movement in the socket, and said socket of each swivel bearing comprises a pair of socket members at opposite sides of the respective bearing ball and engaging the respective bearing ball with a contact pressure which is adjustable by adjustment of one socket member relative to the other socket member.

13. A device according to claim 10, and further including:

said pivotal connections of said stabilizing bar comprising respective collars rotatable on the lower end portions of said respective shafts, and said elongate stabilizing bar being connected with and extending between said collars.

14. A device according to claim 10, and further including:

said pivotal connections of said stabilizing bar comprising collars rotatable on the lower ends of said shafts, said elongate stabilizing bar extending between said collars, and said pivotal connections between the end portions of said stabilizing bar and said collars have parallel pivot axes transverse to both said links and said stabilizing bar.

* * * * *